US008065813B2

(12) United States Patent
Siepi

(10) Patent No.: US 8,065,813 B2
(45) Date of Patent: Nov. 29, 2011

(54) EXCAVATION DEVICE AND PROFILE ANALYSES OF THE EXCAVATION ITSELF AND ASSOCIATED METHOD

(75) Inventor: Maurizio Siepi, Cesena (IT)

(73) Assignee: Soilmec S.p.A., Cesena (FC) (IT)

( * ) Notice: Subject to any disclaimer, the term of this patent is extended or adjusted under 35 U.S.C. 154(b) by 0 days.

(21) Appl. No.: 12/797,303

(22) Filed: Jun. 9, 2010

(65) Prior Publication Data

US 2010/0307825 A1 Dec. 9, 2010

(30) Foreign Application Priority Data

Jun. 9, 2009 (IT) ..... TO2009A0438

(51) Int. Cl.
*G01B 5/20* (2006.01)

(52) U.S. Cl. ..... 33/544; 33/302; 33/544.5

(58) Field of Classification Search ..... 33/544, 33/544.1, 544.2, 544.5, 302, 304
See application file for complete search history.

(56) References Cited

U.S. PATENT DOCUMENTS 3,882,606 A * 5/1975 Kaenel et al. ..... 33/544
4,228,593 A * 10/1980 Frank et al. ..... 33/544.3
4,722,142 A * 2/1988 Schmidt ..... 33/834
4,780,962 A * 11/1988 Smith ..... 33/523
4,930,223 A * 6/1990 Smith ..... 33/302
4,953,412 A * 9/1990 Rosenberg et al. ..... 33/544
5,088,336 A * 2/1992 Rosenberg et al. ..... 33/544
5,205,048 A * 4/1993 Toomey et al. ..... 33/544
6,931,748 B2 * 8/2005 Lam et al. ..... 33/544
2010/0307825 A1 * 12/2010 Siepi ..... 175/45

FOREIGN PATENT DOCUMENTS

WO WO 02/068796 9/2002

* cited by examiner

*Primary Examiner* — Yaritza Guadalupe-McCall
(74) *Attorney, Agent, or Firm* — Merchant & Gould P.C.

(57) ABSTRACT

An excavation device (1) and profile analysis of the excavation includes a device (1) realizing excavations of prismatic shape and having a frame (3) and a plurality of excavation wheels (2). The frame (3) includes a first upper section (3*c*), a second intermediate section (3*b*) and a third lower section (3*a*. The excavation wheels (2) are positioned at least within said third section (3*a*). Sensors (4) carry out the measurement of the section and/or the shape of said excavation; the sensors of measure (4) are directed towards the walls of said excavation and measure the profile of said excavation on at least two opposite walls. A method of analysis of a shape and/or a section of an excavation of prismatic shape in the soil includes excavation of the soil through a device (1) having a frame (3) and a plurality of excavation wheels (2). The method includes a phase of measurement of the section and/or shape of said excavation by sensors (4) positioned on the frame (3) and directed towards the walls of said excavation, measuring the profile of the excavation on at least two opposite walls.

16 Claims, 8 Drawing Sheets

EXCAVATION DEVICE AND PROFILE ANALYSES OF THE EXCAVATION ITSELF AND ASSOCIATED METHOD

This application claims benefit of Serial No. TO2009A000438, filed 9 Jun. 2009 in Italy and which application is incorporated herein by reference. To the extent appropriate, a claim of priority is made to the above disclosed application.

BACKGROUND

The present invention relates to the field of the data acquisition systems, and in detail refers to an excavation device and profile analysis of the excavation itself and associated method.

In the field of industrial building, it is known the use of machines for the excavation of diaphragms; these machines use a tool provided with two or more rotating drums—typically the one in opposite direction with respect to the other—provided with teeth for the excavation in the soil and in the rock.

On the machines of known kind, are arranged sensors (such as for instance accelerometers, gyroscopes, inclinometers, depth gauges) which permit to detect the position of the excavation tool during the continuation of the work.

Furthermore, there are also rotating machines known for the excavation of holes in the soil which integrate in the tool or in the cutter head or one or more sensor for measuring the excavation size.

For example, from the document WO 02068796 it is known a device for circular section excavation comprising a plurality of sensors for the determination of the parameters of a hole. The device is adapted to rotate during the penetration in the soil and the sensors mounted upon it permit to detect the rotation of the tool and the ellipticity of the excavated hole.

For measuring the parameters abovementioned, the device shown in figure requires a plurality of sensors arranged on different heights of the excavation tool; the presence of sensors upon different heights represents a disadvantage, as it sets structural constraints for the positioning of sensors in the excavation tool and increases the number of required wirings and the power of the required supply.

The device shown in WO 02068796 is not efficient in case of excavation of prismatic section diaphragms, where the tool does not rotate. In particular, it does not permit to measure the transversal section of the excavation by means of a sensor which rotates together with the head. It should be needed to provide for carrying out a counter-rotation of the sensor, using devices particularly complex from the mechanical point of view, surely subject to possible breakings and therefore not efficient for operating in critical environments such as the one of the underground excavation.

SUMMARY

A first purpose of the present invention is to describe an excavation device and profile analysis of the excavation itself and associated method which is free from the above described inconvenients.

Another purpose of the present invention is to provide for a method of profile analysis of an excavation in the soil, which is free from the above described inconvenients.

According to the present invention an excavation device and profile analysis of the excavation itself and associated method is realized.

According to the present invention it is also provided a method of profile analysis of an excavation in the soil.

BRIEF DESCRIPTION OF THE DRAWINGS

The invention will be now described with reference to the attached drawings, which show a non limiting embodiment, wherein:

FIGS. 7*a*, 7*b*-9 respectively show a second, a third and a fourth embodiment of the device object of the present invention.

With reference to FIG. 1, a first embodiment of an excavation device for the creation of excavations of prismatic shape with profile analysis of the excavation itself is generally designated with 1.

DETAILED DESCRIPTION

Figure 1:
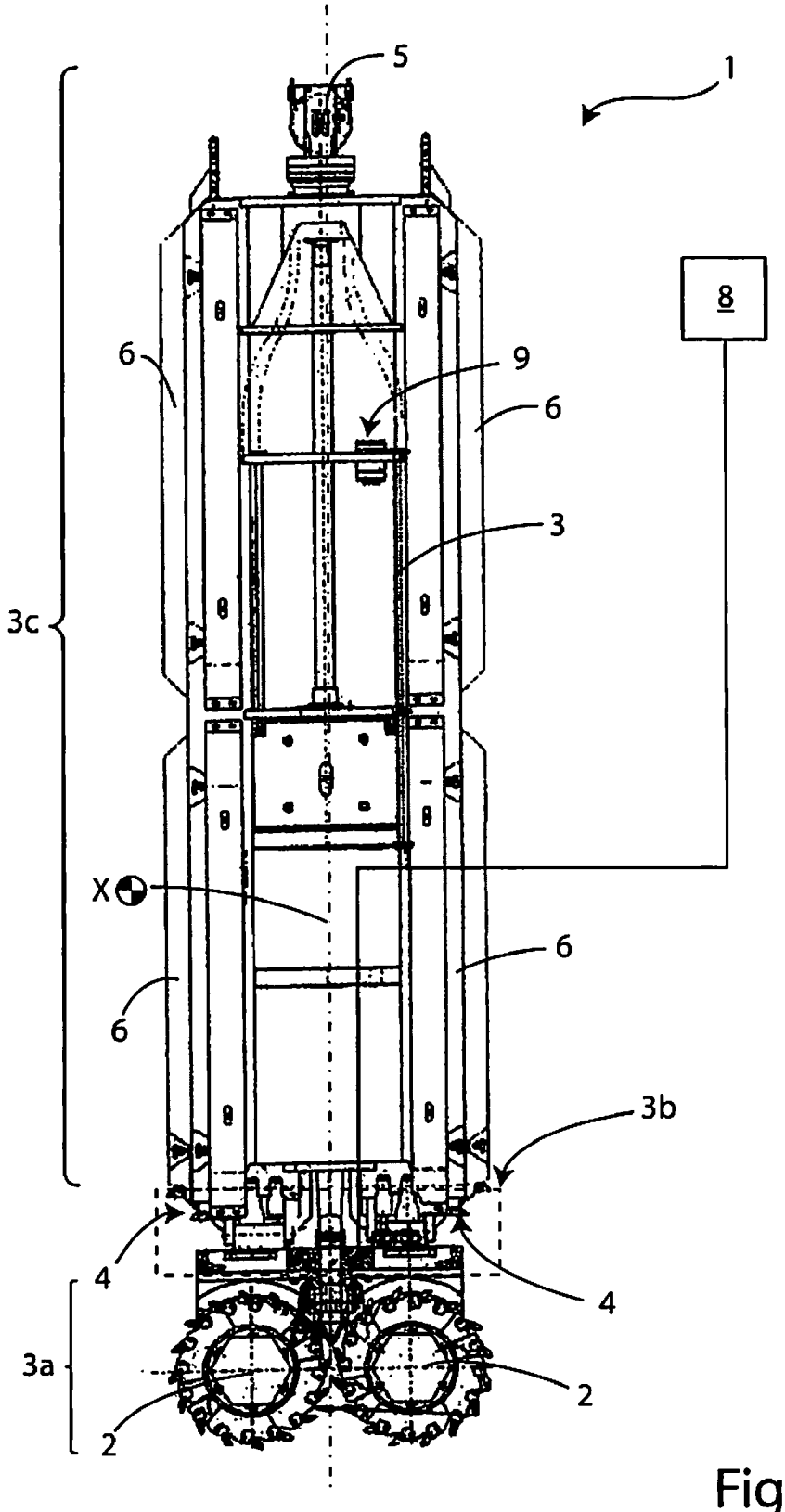
FIG. 1 shows a front view of a first form of embodiment of an excavation device for the creation of excavations of prismatic shape with profile analysis of the excavation itself according to the present invention.

Device 1 is adapted to penetrate into the soil by carrying out, ideally, an excavation without rotation with respect to its axis X, along which the hole itself is dug.

Device 1 comprises at least a couple of horizontal drums 2 rotating around an axis inclined with respect to axis X (in figure, in detail, this axis is orthogonal to axis X) and provided with teeth for the erosion of the soil or of the rock to be excavated. These drums 2 are arranged in a lower section 3*a* of a frame 3 of device 1 and permit device 1 to penetrate in the soil in a direction parallel to axis X, and therefore along a direction of maximum extension of frame 3.

Drums 2 are all arranged in such a way as to rotate on a plane upon which the axis X rests and are arranged symmetrically with respect to this axis. On a same rotation plane, drums 2 rotate one clockwise and the other anticlockwise.

Drums 2 are dominated by an intermediate section of frame 3*b* housing a plurality of sensors 4. Upon the intermediate section of frame 3*b*, frame 3 continues up to an upper ending section 3*c*, wherein at least a block 5 around which it is winded a cable which permits the traction of device 1 in and out from the hole. Lateral guides 6, technically known as "flaps" and arranged along the four lateral surfaces of the frame of device 1, permit to keep the frame in a position substantially centered with respect to the excavation carried out by drums 2 and to correct any undesired rotation of device 1, and form a section along a plane orthogonal to the axis X substantially equal to the prismatic section of the excavation made by drums 2.

As a matter of fact, as mentioned in the introductory part of the present description, a rotation of device 1 is an undesired phenomenon and must be corrected. In fact, ideally speaking, the section of the prismatic excavation should keep itself free from rotation on the axis X with the variation of the height of the depth of the excavation.

The intermediate section of frame 3*b* has a rectangular section, having an area lower with respect to the section of soil excavated by drums 2 and having four lateral walls 7*a*-7*d*;

in this way, all around the intermediate section of frame 3*b* there are empty spaces 100 which separate walls 110 of the excavation from lateral walls 7*a*-7*d*.

Figure 2:
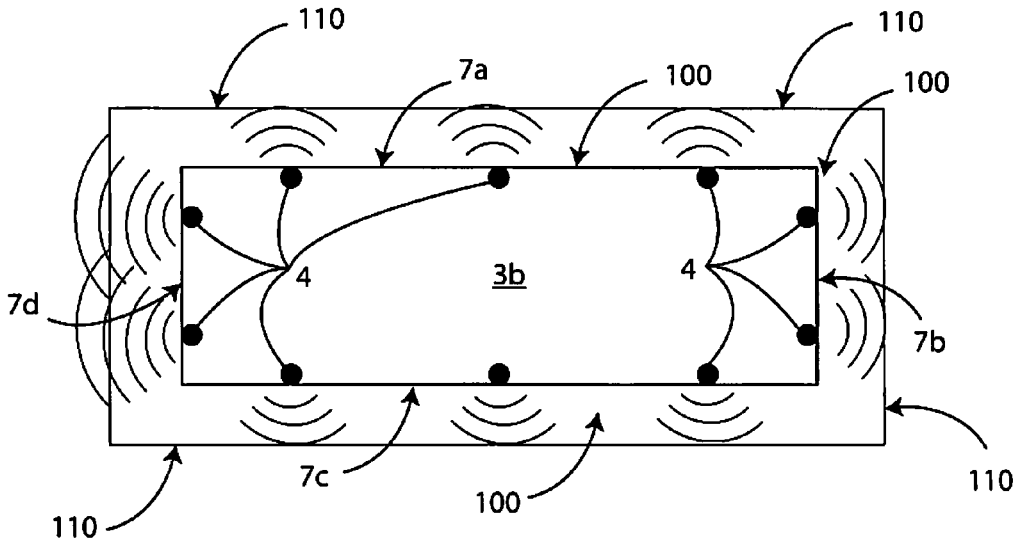
FIG. 2 shows a section of part of the device of FIG. 1.

As it can be observed in FIG. 2, sensors 4 are fixedly arranged upon one only plane of the intermediate section of frame 3*b*, in peripheral position and in such a way as to be equally spaced the one with respect to the other.

In order to correctly detect the profile of the excavation, sensors 4 must be mounted on device 1 in such a way as to be directed towards two opposite walls 110 of the excavation and, preferably, directed towards the lateral walls of higher extension.

Furthermore, sensors 4 are all directed towards the outside of frame 3, and are oriented in such a way as to carry out a measurement substantially in orthogonal direction with respect to the axis X and to the direction of maximum extension of frame 3. Clearly, the measurement direction of sensors 4 cannot be purely orthogonal, because it is known that each sensor 4 has its own measurement beam width, that is it does not measure along a point direction but within a cone of small opening.

Sensors 4 work on ultrasonic frequencies and permit to immediately verify, during the continuation of the excavation, the presence of out-of-shape profiles and, consequently, the danger of landslides without requiring the extraction of device 1 from the excavation.

Each of sensors 4 measures the distance between wall 7*a*-7*d* upon which it is mounted and the corresponding wall of the excavation facing in the opposed position, by means of a measurement of the trip time (known with the term "round trip time"). As a matter of fact, each sensor 4 sends repeated ultrasonic impulses against the respective excavation wall and measures the time used by that impulse to come back. The measurement of the distance between wall 7*a*-7*d* and the excavation wall is simply obtained by a multiplication between the time used and the propagation speed of the signal divided by two.

Sensors 4 exchange data with a data processing unit 8, which permits to obtain in real time the shape of the excavation at the varying of the depth of penetration of device 1 and, together with other known sensors 9 installed on frame 3 of device 1 (gyroscopes, accelerometers, inclinometers) permits to detect also the shifting of the axis X of device 1 with respect to the theoretical excavation axis or the relative rotation of device 1 with respect to an external reference.

In detail, sensors 4 can exchange data with data processing unit 8 or through a wired technique or via radio. Using a cable data transmission, it will be necessary to provide for conductors sufficiently long in order to reach the surface (generally already present in these tool typologies); in the second case, that is when the data transmission among sensors 4 and data processing unit 8 is done via radio, it will be necessary to provide device 1 with one or more antennas for the data transmission, such as also data processing unit 8 must have a respective antenna for the reception. Data processing unit 8 is conveniently positioned in the frame of device 1 and transmits data on the surface for the real-time visualization and for their next storage. Data processing unit 8, is preferably inserted within a watertight box appropriately studied for the conditions of use during the creation of the excavations in the underground and sends signals using CAN technology towards the surface of the excavation itself by using only two cables of data transmission opportunely covered and shielded from the external agents.

Alternatively, processing unit 8 already positioned on the frame in upper section 3*c* and necessary for the reception of the information deriving from the sensors on the excavation tool can be potentiated. As another alternative, data processing unit 8 is positioned outside of the excavation. In this case all the sensors installed on device 1 have to singularly transmit the data toward the surface of the excavation itself. For this reason the number of electrical conductors towards the surface increases both in number and in terms of the total required size.

According to a first functioning mode, data processing unit 8 carries out a data measurement procedure according to the measures of the distance detected by the couples of sensors 4 opposed the one with respect to the other. According to the first functioning mode, the shape and/or section of the excavation can be identified because the measures of the intermediate section of frame 3*b* is known and the distances among walls 7*a*-7*d* and the excavation walls are detected by the opposed couples of sensors 4.

The measurement carried out by device 1 is important when operating in unstable lithologic conditions, where it can be real the danger of local landslides of the excavation walls (action of bulbs). In this case, in correspondence of the action of bulbs, the interested sensors detect an anomaly of empty space 100.

Figure 3:
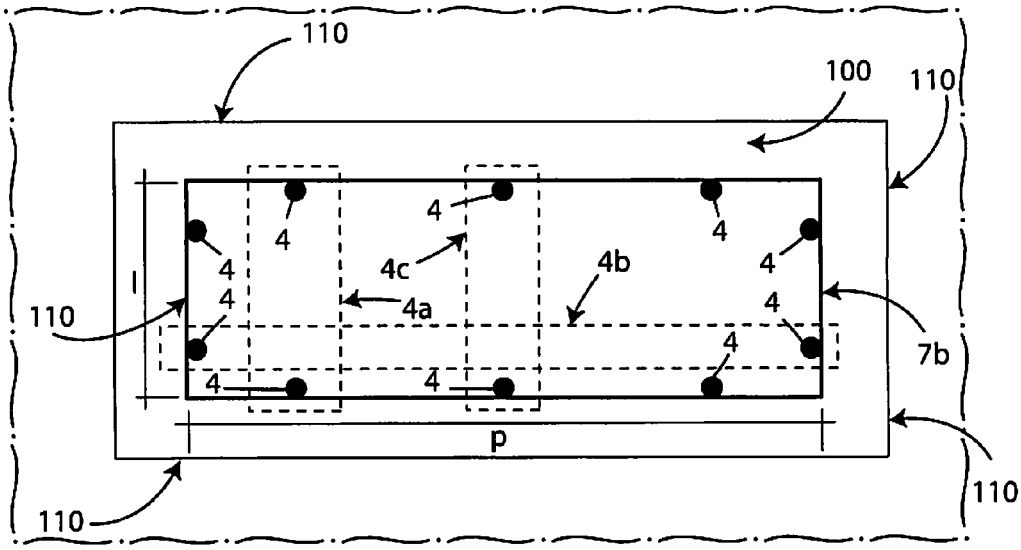
FIG. 3 shows a section of part of the device of FIG. 1 in a particular operating configuration.

As more clearly shown in FIG. 3, during a first time instant t0 the measures of a first couple 4*a* of sensors 4 are sent to data processing unit 8, then of a second couple 4*b* and so on till the reception of the information of the last couple 4*c* of sensors 4 positioned on the intermediate section of frame 3*b*.

Being known a length l and a depth p of the intermediate section of frame 3*b*, by adding the measures of couples 4*a*, 4*b*, 4*c* of the sensors to the measure of length l or depth p, the size of the excavation section is obtained. In detail, because of the fact that the first couple 4*a* of sensors 4 is oriented in the sense of the length of the intermediate section of frame 3*b*, the measures provided by it will be a part of the measurement of the depth of the excavation section; vice versa the second couple 4*b* of sensors 4 is oriented in the direction of depth; therefore the supplied measurements contribute to the measurement of the depth of the excavation section The length and the depth of the excavation section are directly calculated by data processing unit 8.

Figure 4:
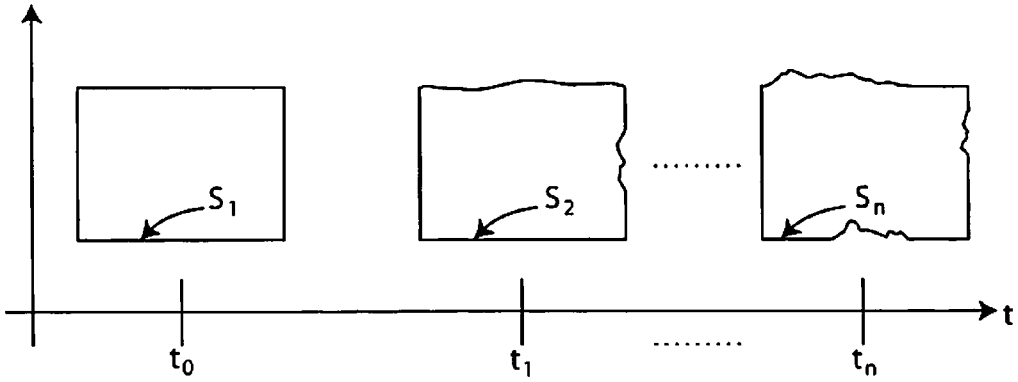
FIG. 4 schematically shows a first time diagram of the evolution of sections of excavations.

As shown in FIG. 4, the preceding data measurement procedure, is repeated at predetermined time intervals by data processing unit 8; in this way, by repeating this procedure in times t1, t2, t3, . . . subsequent to t0 it is possible to obtain more measures of the excavation section s1, s2, . . . , sn, by determining thus the profile of the excavation itself.

Figure 5:
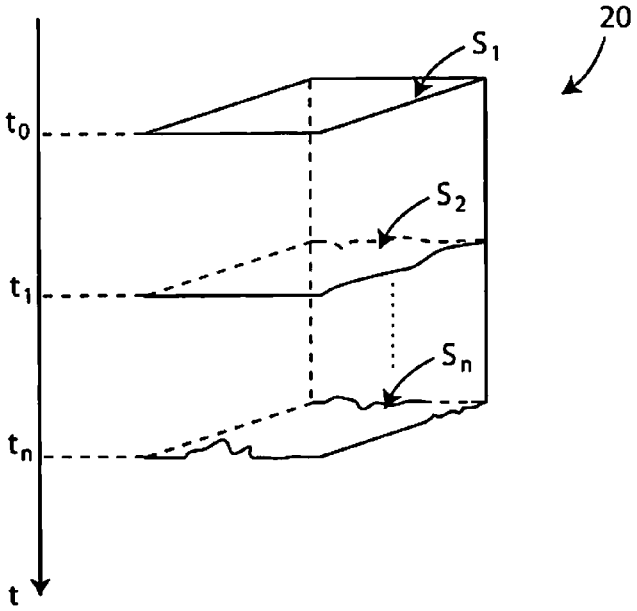
FIG. 5 shows a second perspective time diagram, of the evolution of sections of excavations.

In detail, the profile given by measures s1, s2, . . . , sn of the excavation section is stored in data processing unit 8; through this storage it is possible to trace a discrete profile 20 of the excavation itself during the time, as shown in FIG. 5 and, through an integration process, it is possible to obtain also the volume of the excavated material, which can be then compared to a theoretical volume—calculated according to the size of the section detected by drums 2.

Clearly, profile 20 of the excavation will be more precise in terms of time and depth being the time instants t1, t2, . . . , tn closer and—equally—the more precise in terms of section measure the more sensors 4 are mounted in higher number. A higher limit to the precision obtainable in measurements is also given by the intrinsic accuracy of sensors 4 and by the ratio among the size of the intermediate section of frame 3*a* and the number of sensors 4 here mounted.

During the acquisition of the measures of the excavation section, data processing unit 8 stores, for each section s1, s2, . . . , sn of the excavation carried out, also the depth at which it has been obtained.

During the descent for the excavation, the acquisition of section measures s1, s2, . . . , sn can be set in function of the excavation depth or of the time passed from the preceding acquisition. In fact, if the soil collapses, device 1 removes material without moving forward and in this case it is important to correlate the measures to the excavation time. When device 1 rapidly moves forward in the soil—on the contrary—it is important to carry out the measures in function of the depth (for example every 50 cm). The acquisition can be done also during the ascent of device 1 with the already shown methods, or by detecting the same sections measure during the advancement.

In this way, by proceeding with the ascent of device 1 from the basis of the hole, possible shiftings among the sections sn, . . . , s2, s1 acquired during the drilling are analyzed with the next section measurements.

If at equal depth the two measures of the excavation section significantly vary (for example: up to 10-25 cm for a little action of bulbs or normal adjustments, 25-50 cm for significant alarms and necessity of monitoring the excavation, more than 50 cm for potential collapse dangers), and if the number of sensors 4 interested by the phenomenon of variation is indicative of a dangerous situation (for example: if only one sensor 4 detects the anomaly, the problem is localized and probably refers to an empty space or a cavity, in case the anomaly is on the other hand detected by all the sensors positioned on a side of device 1, the potential danger of collapse is obviously higher), then data processing unit 8 provides for sending an alarm signal to a user who commands the drilling. In this way, it is possible to promptly actuate operations for the making safe of the excavation, with the increase of the density of the excavation mud for increasing the hydraulic load. On the other hand, in extreme cases the drilling can be interrupted and the excavation filled.

According to a second functioning method, data processing unit 8, on the other hand, processes the data deriving from each of sensors 4 in a distinct way and combines them with the data of traditional sensors 9, for permitting not only to detect the excavation section but also its positioning in the space; in this way it is possible to determine also the shifting of the axis of the excavation with respect to the axis X, that is therefore to determine if device 1 is rotating around itself or, even worse, is not vertically moving forward but transversally. In detail, this detection is carried out through a system provided with a gyroscopic sensor which detects the rotation of device 1 around axis X and which is generally combined with inclinometers which determine the angles along the axis lying on the transversal section. By setting a depth variation $\Delta p$ covered with a certain inclination angle, the system determines the lateral shifting along the other axis and this measure determines the shifting on the transversal plane of the advancement axis X of device 1 itself.

In these cases, corrections can be made, by actuating lateral guides 6 after having carried out the measures with accelerometers which are used for determining the shifting of the axis X due to lateral translations without inclinations of device 1.

Figure 6:
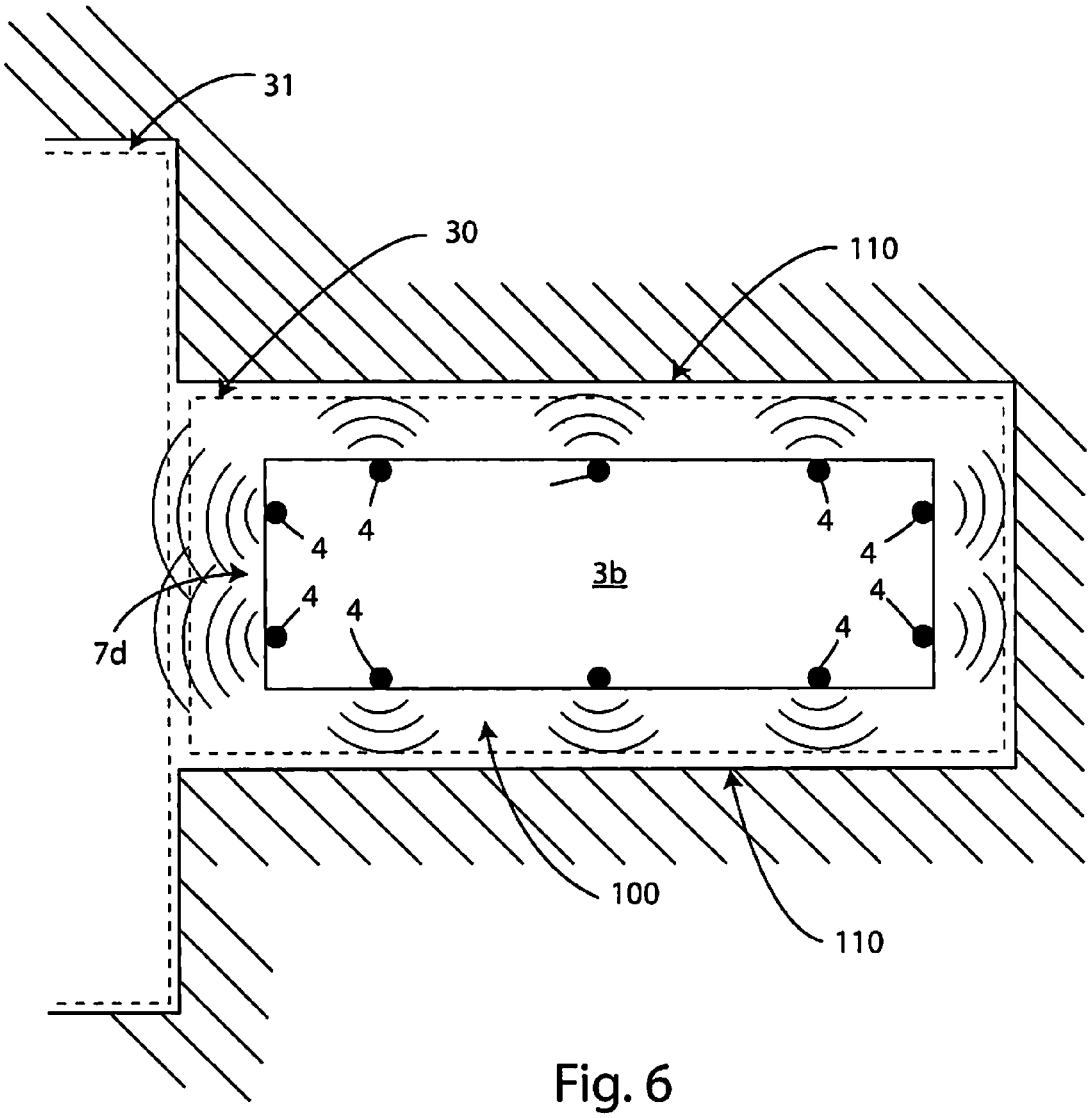
FIG. 6 shows a section of two adjacent excavations.

Device 1 permits also to verify the effective superimposition of two diaphragm excavations the one adjacent to the other. As shown in FIG. 6, in fact, if two excavations 30, 31 are adjacent, they are then limited, each one, only by three lateral walls 110. In this case, for verifying the effective superimposition of two excavations 30, 31, sensors 4 of one of lateral walls 7*a*-7*d* (in FIG. 6, the sensors which face on wall 7*d*) have to find a distance higher than the others or, alternatively, show a cavity which extends outside of their range. Vice versa, if the two excavations 30, 31 begin to diverge the one with respect to the other, between them there would create again a wall of ground which would be detected by sensors 4 of wall 7*d*.

Figure 7A:
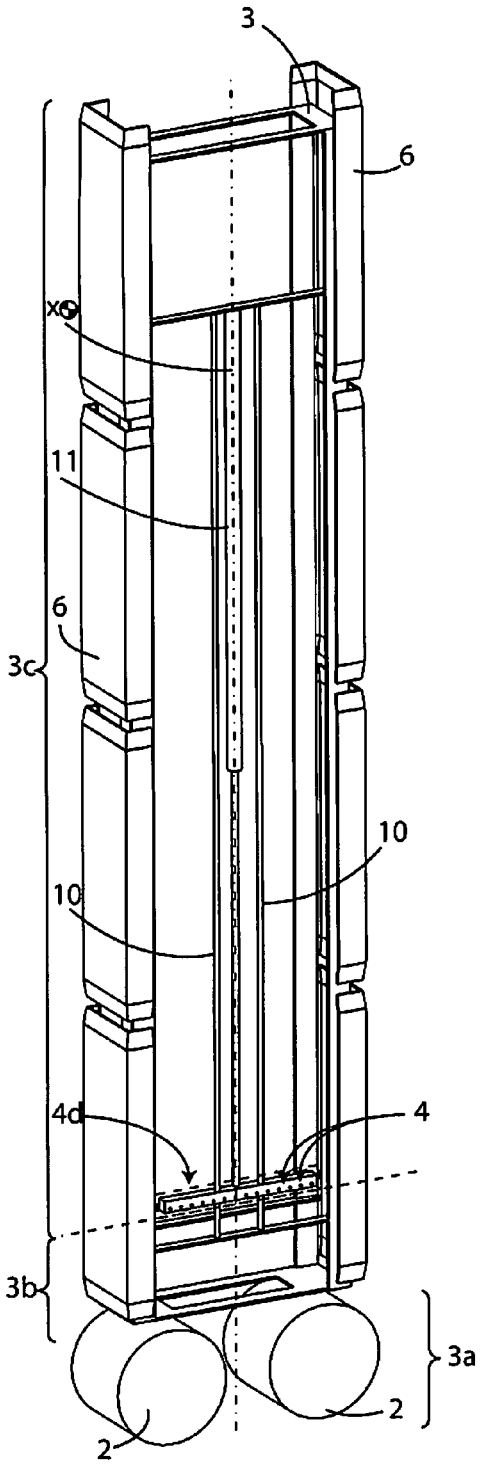
Figure 7B:
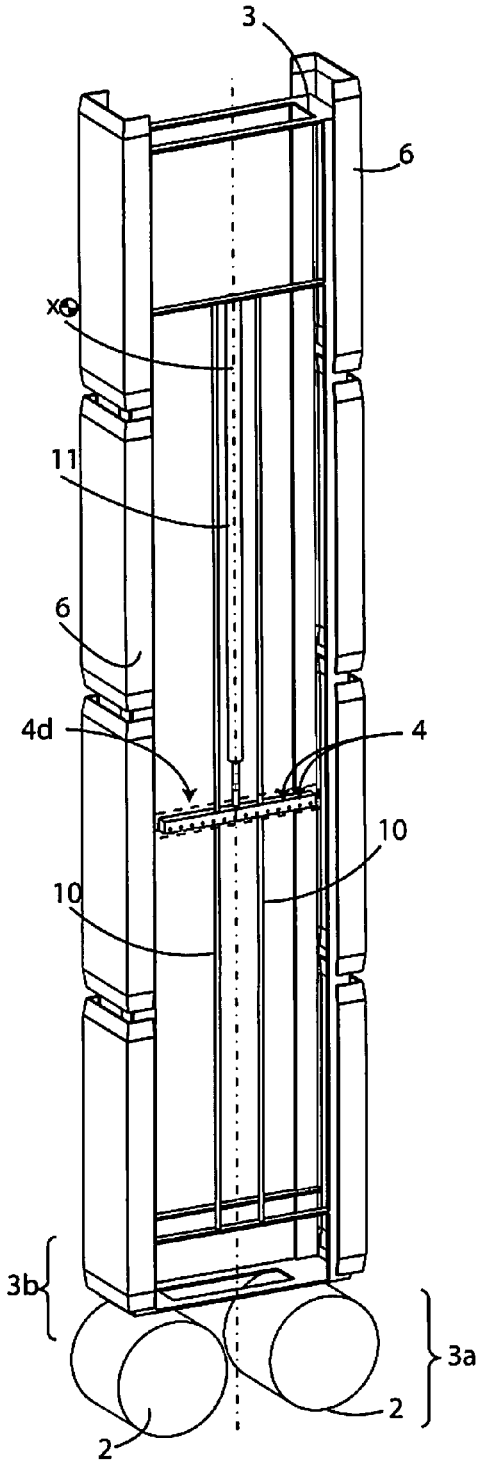

A second embodiment of device 1 is shown in FIGS. 7*a*, 7*b*. In this case, sensors 4 are fixed upon a guide 4*d* slidingly engaged to frame 3 of device 1, able to slide from a first and a second operating position upon a plurality of guides 10 parallel among them and to the axis X. Therefore, sensors 4 which are fixed upon guide 4*d* in such a way as to detect—in their complex—a direction orthogonal to axis X, vertically and autonomously slide on frame 3 and being engaged to guides 10, which offer an integral reference to the frame itself, cannot rotate or move axially with respect to it.

In fact, in the opposite case, the reference of the position of the malformations in the hole of the wall examined by sensors 4 would be lost.

In the second embodiment described in FIGS. 7*a*, 7*b*, the movement of guide 4*d* is carried out through an extensible jack 11, which is provided with a tool for the measurement of the position of guide 4*d* with respect to frame 3 of device 1; this tool is electrically connected to data processing unit 8 and permits to correctly identify the height at which guide 4*d* is positioned even if it slides with respect to the frame. The importance of this tool is high: in fact, without it, with the actuation of jack 11, it would be impossible to detect the correct depth at which the geometry and/or excavation section measurements are being made.

In detail, jack 11 is able to move guide 4*d* from the lower end of upper ending section 3*c* of frame 3, near the intermediate section of frame 3*b* (FIG. 7*a*), along the whole vertical path (FIG. 7*b*) up to the reaching of an upper end stroke substantially in correspondence with an upper area of upper ending section 3*c* of frame 3.

The presence of a rigid structure for the movement of sensors 4 is important because it permits to avoid the extraction of device 1 itself from the bottom of the excavation, if the probable presence of landslides during the continuation of the excavation itself is to be analyzed; device 1 remains then with excavation wheels 2 in contact with the bottom of the excavation itself, even without the stopping of excavation wheels 2, whereas the rigid structure is moved upwards and then again downwards. During this movement, the section and/or geometry of the excavation is again acquired as previously described.

Figure 8A:
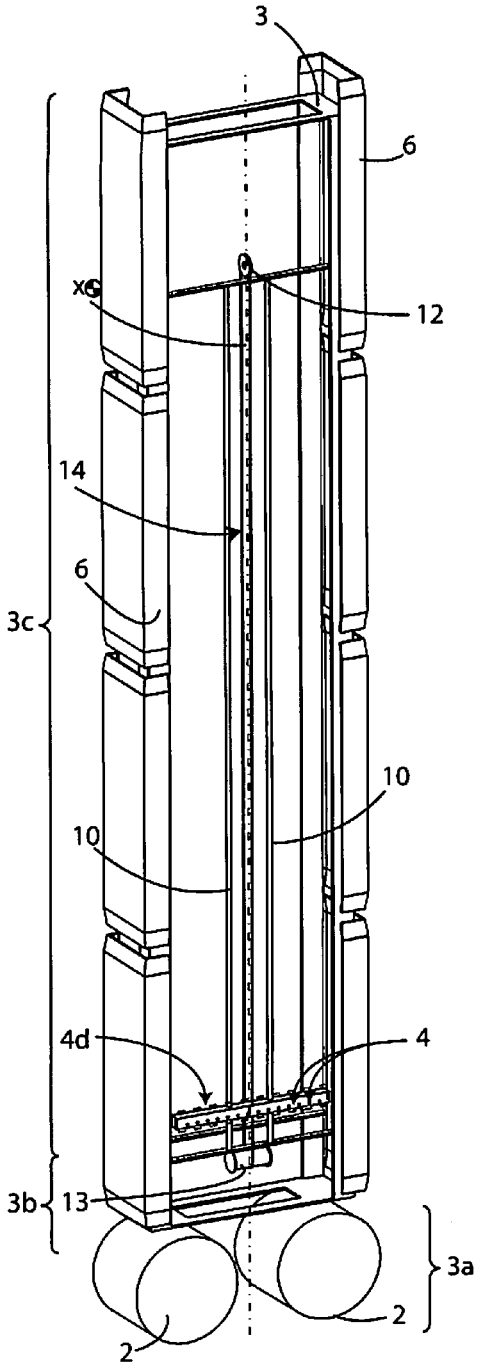
Figure 8B:
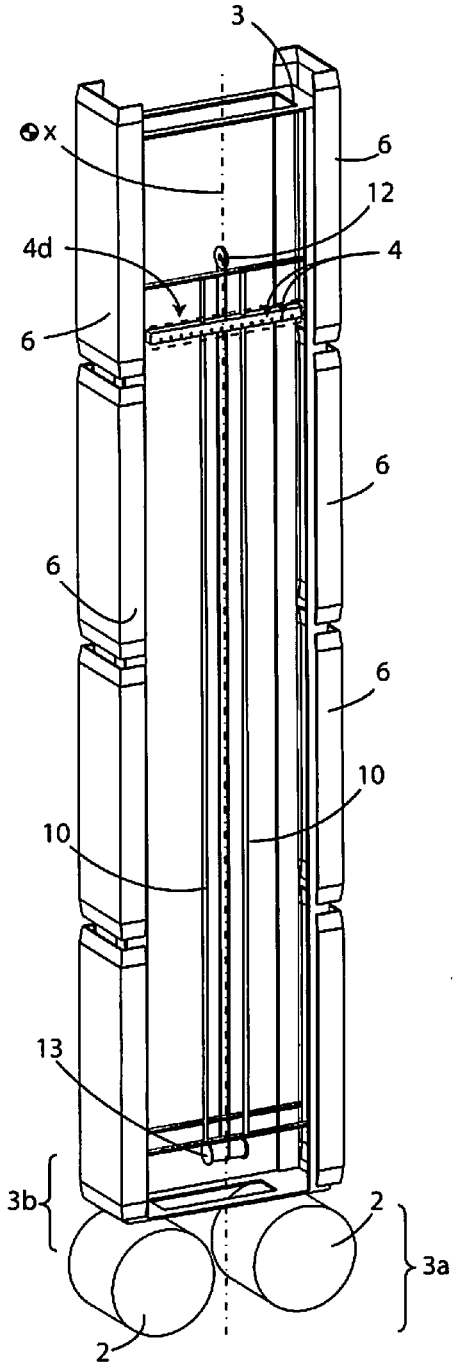

A third embodiment of the device object of the present invention is shown in FIG. 8*a* and in FIG. 8*b*. The third embodiment of device 1 differs from the second—previously described—for the means of actuation of the movement of guide 4*d* of the sensors; in this case, in fact, the means of actuation comprises a winch system.

As shown in FIGS. 8*a*, 8*b*, said system comprises an upper pulley 12 and a lower winch 13 upon which a traction cable 14 slides, constrained to guide 4*d*.

As shown in figures, in order to permit the sliding along the upper ending section 3*c* of frame 3, upper pulley 12 is in the upper end of this section, whereas winch 13 is substantially in intermediate section 3*b* of frame 3. This embodiment permits to use the whole height of device 1 as useful stroke for guide 4*d* which holds the sensors, therefore ensures a better mounting covering of the profile of the excavation.

The position of guide 4*d* with respect to frame 3 can be determined either with a rotation sensor (encoder) positioned in proximity either of pulley 12 or on the rotation axis of winch 13, or could be determined with a depth gauge which reads directly the stroke of guide 4*d* with respect to a reference point positioned on frame 3.

Figure 9:
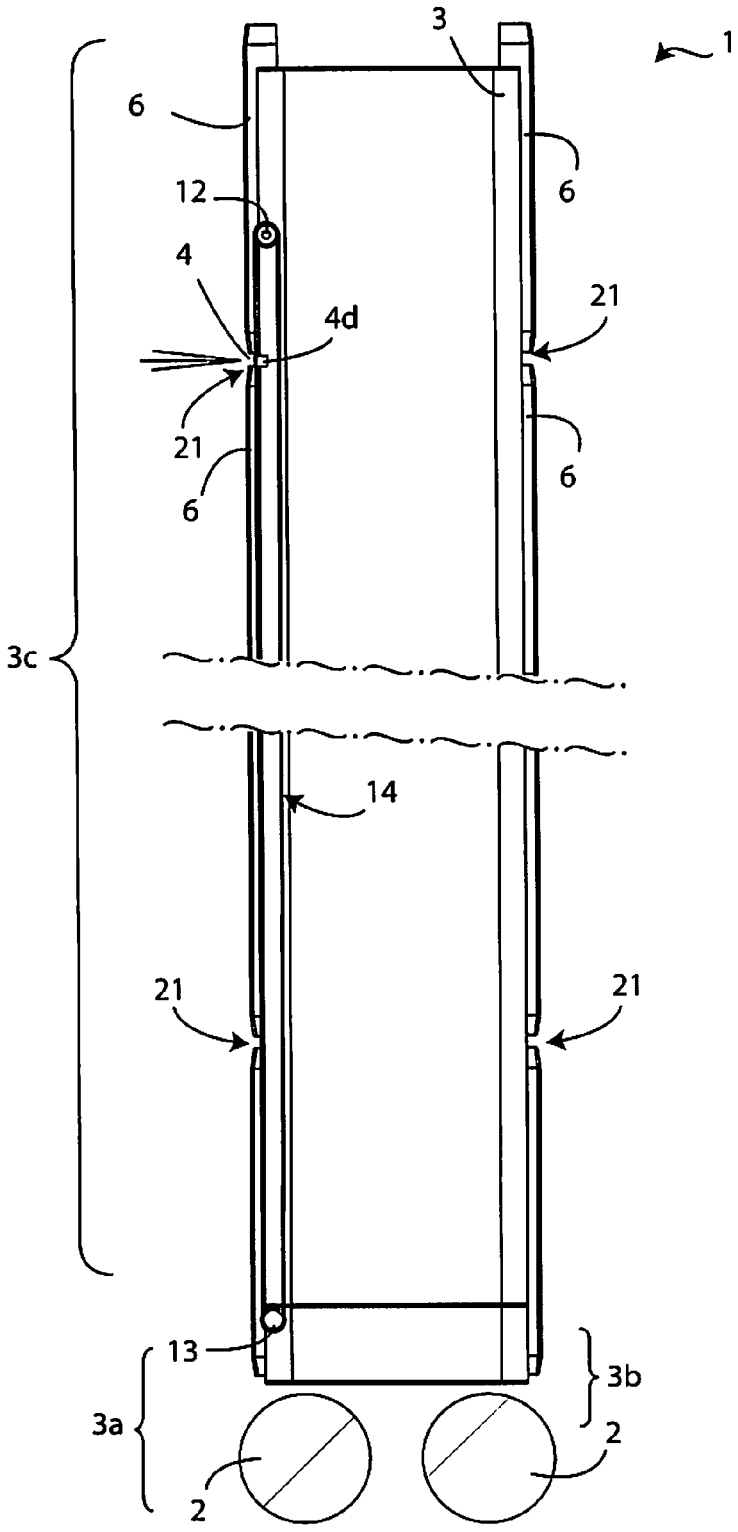

A fourth embodiment of the present invention is shown in FIG. 9; in this case sensors 4 are mounted on a guide 4*d* vertically sliding in parallel with respect to axis X in such a way as to laterally detect the profile of the excavation.

Even in the fourth embodiment, the movement of guide 4*d* is done through a winch system 7*a* as the one described for the third embodiment of the present invention.

Even if not detectable in figure, guides 10 are still present for the integral reference of guide 4*d* to frame 3 of device 1 for avoiding rotation and movements of sensors 4 with respect to frame 3.

In this case, however, the detection of the profile of the excavation—made by sensors 4—cannot be continuous, because sensors 4 are mounted in a back position with respect to lateral guides (flaps) 6. If the detection would be continuous, the measurement made during the movement of sensors 4 between the first and the second position of use would be distorted by the detection of the back profile of lateral guides 6.

Lateral guides 6 do not uninterruptedly extend upon the whole lateral development along the axis X of device 1; on the contrary, they have a reduced length and are mounted in a number higher than one for each side of frame 3 (in FIG. 9 are shown three for each part). An interval of empty frame 21 is left between the one and the other lateral guide 6.

In this case, the detection of the profile of the excavation is made with a spot mode, only in correspondence with the intervals of empty frame 21. This detection mode does not influence in a significantly negative way the functioning of device 1, as for their nature the landslides of an excavation vertically extend upon lengths very relevant with respect to the ones available for the spot reading. Therefore, by installing lateral guides 6 of comparable length, it is possible to carry out anyway a good scanning or detection of the profile of the excavation carried out.

It is important to underline that in FIG. 9 it has been shown sensor block 4 only on one side of the device for simplicity of representation: in order to detect the geometry and the excavation section it is anyway necessary that a second guide 4*a* of sensors 4 is positioned on the opposite side, independently or integrally movable with the previous one.

Finally, it is to be highlighted that, in case sensors are mounted being directed towards only one couple of opposite walls of the excavation, the measures of the section can anyhow be calculated considering as constant the measures of the distance from the walls on the two sides of the excavation not measured; in particular, in fact, it is opportune to consider possible problems of landslide mainly on the sides of the excavation with higher extension; a possible landslide upon one or both the sides of lower extension results less relevant in these cases (in particular when the ratio among the measures of the couples of opposite sides is strongly balanced upon one of the couples of sides, in some cases this ratio reaches values as 1:3 or 1:4) and anyway it would be partially detected by at least one of sensors 4 nearer to the angle among the walls of the device.

The advantages of device 1 up to here described are clear in the light of the previous description. In particular, it permits the monitoring of the profile of the excavation of prismatic shape both during the continuation of the excavation and after it, thus evaluating possible differences in the measurements made which can be due to, for example, landslides.

The after-excavation analysis of the prismatic section and of the profile of the excavation is particularly useful for diaphragms, because they, differently from the circular holes, cannot count on the stabilizing and unloading effect of the forces typical of the arch-shaped or circular walls. In this way, for the monitoring of the stability of excavation walls 11, it is not anymore necessary to extract the drilling device and successively to introduce a different element of measure; the monitoring of the stability of walls 110 is wholly guaranteed without the complete extraction of device 1 which, however, can anyway begin again the monitoring of the walls even on different drilling times.

Equally, device 1 according to the present invention permits to monitor also the effective superimposition of different diaphragm excavations, still through the measurement of the section of the excavation.

The integration of the control of the excavation profile in a unique device which carries out also the drilling brings to a double advantageous cost reduction:

- on the one hand, a first cost reduction derives from the presence of a unique device; and
- on the other hand, this cost reduction is brought by the less time used in the analysis of the excavation size, which with respect to the use of two different devices is highly reduced.

Finally, it is clear that to the device up to here described can be applied some variants, changes or adaptations without exiting from the protective scope of the claims of the present invention.

For example, block 5 for the uplifting and the lowering of device 1 can be replaced by a different uplifting means, able anyway to permit the same operations.

Furthermore, systems of linear movement alternative to the ones described for the second, third and fourth embodiment (devices with rack, gearmotor, clutch wheels, . . . ) can be advantageously applied because equivalent.

It is also possible to make openings on the lateral guides in such a way as to permit that the sensor can measure the distance from the wall passing through the opening made on the lateral guide. In this case it is possible to increase the number of holes for having smaller reading pitches during the measurement.

It is finally clear that it is possible to associate to the device up to here described other excavation or mixing wheels, positioned for example upon one end of the frame opposite with respect to the one where there are the lower excavation wheels.

The invention claimed is:

1. Excavation device for and profile analysis of an excavation, the device creating excavations of prismatic shape and comprising a frame and a plurality of excavation wheels; said frame comprising a first upper section, a second intermediate section and a third lower section; said excavation wheels being positioned at least within said third section;

a plurality of sensors for measuring a section and/or a shape of said excavation; said sensors, are directed towards walls of said excavation and measure a profile of said excavation on at least two opposite walls.

2. The device according to claim 1, wherein said sensors are arranged on a single plane of said frame, and wherein said single plane is orthogonal to an axis of maximum extension of said frame.

3. The device according to claim 2, wherein said sensors are arranged upon said excavation wheels.

4. The device according to claim 2, wherein said sensors are slidingly engaged to said frame of said device, and slide on at least a guide movable parallelly to an axis of said device; said guide possessing a respectively first superior and a second lower position of use and being movable between said first and said second position of use.

5. The device according to claim 1, wherein said second section of said frame has a rectangular shape having lateral walls and wherein said sensors are arranged in said second section in perimetrical position along said lateral walls.

6. The device according to claim 5, wherein said second section includes an area lower than the excavation area; said lateral walls of said second section being separated from lateral walls of said excavation by an empty space.

7. The device according to claim 1, wherein said plurality of sensors is of ultrasonic type and exchanges data with a data processing unit.

8. The device according to claim 7, wherein said data processing unit is positioned on the surface, outside of said excavation.

9. The device according to claim 7, wherein said sensors are arranged in opposed couples, wherein each couple comprises two sensors arranged on opposite lateral walls of said second section of the frame; each of the couples of sensors measuring a distance between a respective lateral wall and a portion of a respective excavation wall facing in an opposed position.

10. The device according to claim 7, further comprising inclination and rotation sensors of said device in said excavation and wherein said sensors measure each one the distance between the lateral wall and the portion of respective excavation wall place in front of the sensor; said inclination and rotation sensors being connected to said data processing unit for the signaling of: variations of the inclination of the excavation and of the rotation of said device in said excavation.

11. The device according to claim 7, wherein said data processing unit permits tridimensional visualization of the shape of said excavation.

12. The device according to claim 1, wherein said data processing unit is positioned on the frame of said device, and wherein data generated by said plurality of sensors are transmitted through CAN technology.

13. Method of analysis of a shape and/or a section of an excavation of prismatic shape in the soil, said method comprising a phase of excavating said soil through a device comprising a frame and a plurality of excavation wheels; said method also comprising a phase of measuring the section and/or shape of said excavation, during or at the end of said phase of excavation, of sensors positioned on said frame of said device and directed towards the walls of said excavation, measuring said section of said excavation on at least two opposite walls.

14. The method according to claim 13, wherein said sensors produce electronic data processed by a data processing unit, and wherein calculation of said section of said excavation is made through an addition of a measure of length and depth of said frame of said device and of a value of reciprocal distance among said sensors and the walls of said excavation.

15. The method according to claim 14, further comprising:

a step of comparing section data and/or shape of said excavation acquired at predetermined intervals of height of depth during a phase of continuing the excavation downwards with section data and/or shape acquired by the sensors during a phase of elevating said device from said excavation; and a step of signaling the differences in the measurements, for an equal depth, among said data acquired during the phase of continuing and the data acquired during said phase of elevating.

16. The method according to claim 13, also comprising a step of handling of said sensors along an axis of said device for detecting said geometry of the excavation, wherein said step of handling is made by linear actuator means; said linear actuator means acting on a movable guide, upon which said sensors are fixed.

* * * * *